US007311862B2

(12) United States Patent
Prasad

(10) Patent No.: US 7,311,862 B2
(45) Date of Patent: Dec. 25, 2007

(54) METHOD FOR MANUFACTURING MICROPOROUS CMP MATERIALS HAVING CONTROLLED PORE SIZE

(75) Inventor: Abaneshwar Prasad, Naperville, IL (US)

(73) Assignee: Cabot Microelectronics Corporation, Aurora, IL (US)

( * ) Notice: Subject to any disclaimer, the term of this patent is extended or adjusted under 35 U.S.C. 154(b) by 0 days.

(21) Appl. No.: 11/265,607

(22) Filed: Nov. 2, 2005

(65) Prior Publication Data

US 2006/0052040 A1 Mar. 9, 2006

Related U.S. Application Data

(63) Continuation-in-part of application No. 10/282,489, filed on Oct. 28, 2002.

(51) Int. Cl.
*C08J 9/28* (2006.01)

(52) U.S. Cl. ..... 264/28; 51/296; 521/64; 264/45.9

(58) Field of Classification Search ..... 264/28, 264/45.9; 521/61, 64, 142, 143, 155; 51/296
See application file for complete search history.

(56) References Cited

U.S. PATENT DOCUMENTS 4,138,228 A 2/1979 Hartfelt et al.
4,239,567 A 12/1980 Winings
4,954,141 A 9/1990 Takiyama et al.
5,182,307 A 1/1993 Kumar
5,489,233 A 2/1996 Cook et al.
5,605,760 A 2/1997 Roberts
5,628,862 A 5/1997 Yu et al.

(Continued)

FOREIGN PATENT DOCUMENTS

EP 1046466 A2 10/2000

(Continued)

OTHER PUBLICATIONS

Kapnistos, et al. "Determination of both the binodal and spinodal curves in polymer blends by shear rheology" Europhysics Lett., vol. 34, pp. 513-518 (1996).

(Continued)

*Primary Examiner*—Allan R. Kuhns
(74) *Attorney, Agent, or Firm*—Thomas Omholt; Steven Weseman; Robert J. Ross

(57) ABSTRACT

A method of manufacturing a chemical-mechanical polishing (CMP) pad comprises the steps of (a) forming a layer of a polymer resin liquid solution (i.e., a polymer resin dissolved in a solvent); (b) inducing a phase separation in the layer of polymer solution to produce an interpenetrating polymeric network comprising a continuous polymer-rich phase interspersed with a continuous polymer-depleted phase in which the polymer-depleted phase constitutes about 20 to about 90 percent of the combined volume of the phases; (c) solidifying the continuous polymer-rich phase to form a porous polymer sheet; (d) removing at least a portion of the polymer-depleted phase from the porous polymer sheet; and (e) forming a CMP pad therefrom. The method provides for microporous CMP pads having a porosity and pore size that can be readily controlled by selecting the concentration polymer resin in the polymer solution, selecting the solvent based on the solubility parameters of the polymer in the solvent polarity of solvent, selecting the conditions for phase separation, and the like.

10 Claims, 4 Drawing Sheets

U.S. PATENT DOCUMENTS

| | | | | |
|---|---|---|---|---|
| 5,684,055 | A | 11/1997 | Kumar et al. | |
| 5,893,796 | A | 4/1999 | Birang et al. | |
| 5,964,643 | A | 10/1999 | Birang et al. | |
| 6,022,268 | A | 2/2000 | Roberts et al. | |
| 6,045,439 | A | 4/2000 | Birang et al. | |
| 6,062,968 | A | 5/2000 | Sevilla et al. | |
| 6,089,965 | A | 7/2000 | Otawa et al. | |
| 6,117,000 | A * | 9/2000 | Anjur et al. | 451/526 |
| 6,120,353 | A | 9/2000 | Suzuki et al. | |
| 6,146,242 | A | 11/2000 | Treur et al. | |
| 6,169,122 | B1 | 1/2001 | Bizard et al. | |
| 6,171,181 | B1 | 1/2001 | Roberts et al. | |
| 6,231,942 | B1 | 5/2001 | Blizard et al. | |
| 6,235,380 | B1 | 5/2001 | Tupil et al. | |
| 6,245,406 | B1 | 6/2001 | Kuramochi et al. | |
| 6,248,000 | B1 | 6/2001 | Aiyer | |
| 6,284,810 | B1 | 9/2001 | Burnham et al. | |
| 6,328,644 | B1 | 12/2001 | Kuramochi et al. | |
| 6,358,130 | B1 | 3/2002 | Freeman et al. | |
| 6,368,200 | B1 | 4/2002 | Merchant et al. | |
| 6,454,634 | B1 | 9/2002 | James et al. | |
| 6,626,740 | B2 * | 9/2003 | Baker et al. | 451/41 |
| 6,641,471 | B1 | 11/2003 | Pinheiro et al. | |
| 6,656,018 | B1 * | 12/2003 | Hsu et al. | 451/41 |
| 2001/0053658 | A1 | 12/2001 | Budinger et al. | |
| 2002/0010232 | A1 | 1/2002 | Ogawa et al. | |
| 2002/0016146 | A1 | 2/2002 | Kuramochi et al. | |
| 2002/0072296 | A1 | 6/2002 | Muilenburg et al. | |
| 2002/0098790 | A1 | 7/2002 | Burke | |
| 2002/0123300 | A1 | 9/2002 | Jones et al. | |
| 2004/0082276 | A1 | 4/2004 | Prasad | |

FOREIGN PATENT DOCUMENTS

| | | | |
|---|---|---|---|
| EP | 1108500 | A1 | 6/2001 |
| EP | 1211024 | A2 | 6/2002 |
| WO | WO 98/28108 | A1 | 7/1998 |
| WO | WO 00/59702 | A1 | 10/2000 |
| WO | WO 01/15863 | A1 | 3/2001 |
| WO | WO 01/15885 | A1 | 3/2001 |
| WO | WO 01/36521 | A2 | 5/2001 |
| WO | WO 01/68322 | A1 | 9/2001 |
| WO | WO 01/94074 | A1 | 12/2001 |
| WO | WO 02/02274 | A2 | 1/2002 |
| WO | WO 02/09907 | A1 | 2/2002 |

OTHER PUBLICATIONS

Prasad et al., "Supermolecular morphology of thermoreversible gels formed . . . ", J. Poly. Sci, Part B: Polymer Physics, vol. 32, pp. 1819-1835 (1993).

* cited by examiner

METHOD FOR MANUFACTURING MICROPOROUS CMP MATERIALS HAVING CONTROLLED PORE SIZE

CROSS-REFERENCE TO RELATED APPLICATIONS

This application is a continuation-in-part of application Ser. No. 10/282,489, filed Oct. 28, 2002, which is hereby incorporated by reference.

FIELD OF THE INVENTION

This invention pertains to methods of manufacturing a polishing pad substrate comprising a porous material for use in chemical-mechanical polishing (CMP) methods. More particularly this invention relates to a method of manufacturing a CMP pad having a selected porosity and a relatively narrow pore size distribution.

BACKGROUND OF THE INVENTION

Chemical-mechanical polishing ("CMP") processes are used in the manufacturing of microelectronic devices to form flat surfaces on semiconductor wafers, field emission displays, and many other microelectronic substrates. For example, the manufacture of semiconductor devices generally involves the formation of various process layers, selective removal or patterning of portions of those layers, and deposition of yet additional process layers above the surface of a semiconducting substrate to form a semiconductor wafer. The process layers can include, by way of example, insulation layers, gate oxide layers, conductive layers, and layers of metal or glass, etc. It is generally desirable in certain steps of the wafer process that the uppermost surface of the process layers be planar, i.e., flat, for the deposition of subsequent layers. CMP is used to planarize process layers wherein a deposited material, such as a conductive or insulating material, is polished to planarize the wafer for subsequent process steps.

In a typical CMP process, a wafer is mounted upside down on a carrier in a CMP tool. A force pushes the carrier and the wafer downward toward a polishing pad. The carrier and the wafer are rotated above the rotating polishing pad on the CMP tool's polishing table. A polishing composition (also referred to as a polishing slurry) generally is introduced between the rotating wafer and the rotating polishing pad during the polishing process. The polishing composition typically contains a chemical that interacts with or dissolves portions of the uppermost wafer layer(s) and an abrasive material that physically removes portions of the layer(s). The wafer and the polishing pad can be rotated in the same direction or in opposite directions, whichever is desirable for the particular polishing process being carried out. The carrier also can oscillate across the polishing pad on the polishing table.

In polishing the surface of a wafer, it is often advantageous to monitor the polishing process in situ. One method of monitoring the polishing process in situ involves the use of a polishing pad having an aperture or window. The aperture or window provides a portal through which light can pass to allow the inspection of the wafer surface during the polishing process. Polishing pads having apertures and windows are known and have been used to polish substrates, such as the surface of semiconductor devices. For example, U.S. Pat. No. 5,605,760 provides a pad having a transparent window formed from a solid, uniform polymer, which has no intrinsic ability to absorb or transport slurry. U.S. Pat. No. 5,433,651 discloses a polishing pad wherein a portion of the pad has been removed to provide an aperture through which light can pass. U.S. Pat. Nos. 5,893,796 and 5,964,643 disclose removing a portion of a polishing pad to provide an aperture and placing a transparent polyurethane or quartz plug in the aperture to provide a transparent window, or removing a portion of the backing of a polishing pad to provide a translucency in the pad. U.S. Pat. Nos. 6,171,181 and 6,387,312 disclose a polishing pad having a transparent region that is formed by solidifying a flowable material (e.g., polyurethane) at a rapid rate of cooling.

Only a few materials have been disclosed as useful for polishing pad windows. U.S. Pat. No. 5,605,760 discloses the use of a solid piece of polyurethane. U.S. Pat. Nos. 5,893,796 and 5,964,643 disclose the use of either a polyurethane plug or a quartz insert. U.S. Pat. No. 6,146,242 discloses a polishing pad with a window comprising either polyurethane or a clear plastic such as Clariflex™ tetrafluoroethylene-co-hexafluoropropylene-co-vinylidene fluoride terpolymer sold by Westlake. Polishing pad windows made of a solid polyurethane are easily scratched during chemical-mechanical polishing, resulting in a steady decrease of the optical transmittance during the lifetime of the polishing pad. This is particularly disadvantageous because the settings on the endpoint detection system must be constantly adjusted to compensate for the loss in optical transmittance. In addition, pad windows, such as solid polyurethane windows, typically have a slower wear rate than the remainder of the polishing pad, resulting in the formation of a "lump" in the polishing pad which leads to undesirable polishing defects. To address some of these problems, WO 01/683222 discloses a window having a discontinuity that increases the wear rate of the window during CMP. The discontinuity purportedly is generated in the window material by incorporating into the window either a blend of two immiscible polymers or a dispersion of solid, liquid, or gas particles.

While many of the known window materials are suitable for their intended use, there remains a need for effective polishing pads having translucent regions that can be produced using efficient and inexpensive methods and provide constant light transmissivity over the lifetime of the polishing pad. The invention provides such a polishing pad, as well as methods of its use. These and other advantages of the present invention, as well as additional inventive features, will be apparent from the description of the invention provided herein.

BRIEF SUMMARY OF THE INVENTION

The present invention provides a method of manufacturing a chemical-mechanical polishing (CMP) pad having controlled pore size utilizing a binodal-spinodal decomposition process. The method comprises the sequential steps of (a) forming a layer of a polymer resin liquid solution (i.e., a polymer resin dissolved in a solvent); (b) inducing a phase separation in the layer of polymer solution to produce an interpenetrating polymeric network comprising a continuous polymer-rich phase interspersed with a continuous polymer-depleted phase in which the polymer-depleted phase constitutes about 20 to about 90 percent of the combined volume of the phases; (c) solidifying the continuous polymer-rich phase to form a porous polymer sheet; (d) removing at least a portion of the polymer-depleted phase from the porous polymer sheet; and (e) forming a CMP pad therefrom. The phase separation can be a binodal decomposition, a spinodal decomposition, solvent-non-solvent induced phase separation, or a combination thereof.

The method provides for porous CMP pads having a porosity and pore size that can be readily controlled by selecting the concentration polymer resin in the polymer solution, selecting the solvent for the polymer based on the solubility parameters of the polymer in the solvent, the polarity of solvent, the polarity of the resin, and the like, and/or selecting the conditions for phase separation (e.g., cooling temperature and rate of cooling, addition of non-solvent), and the like.

A polishing pad substrate and polishing pad prepared by the methods of the invention comprises a polymeric resin defining an open network of substantially interconnected pores having pore sizes in the range of about 0.01 to about 10 microns and having a porosity in the range of about 20 to about 90 percent by volume.

DETAILED DESCRIPTION OF THE INVENTION

Figure 1:
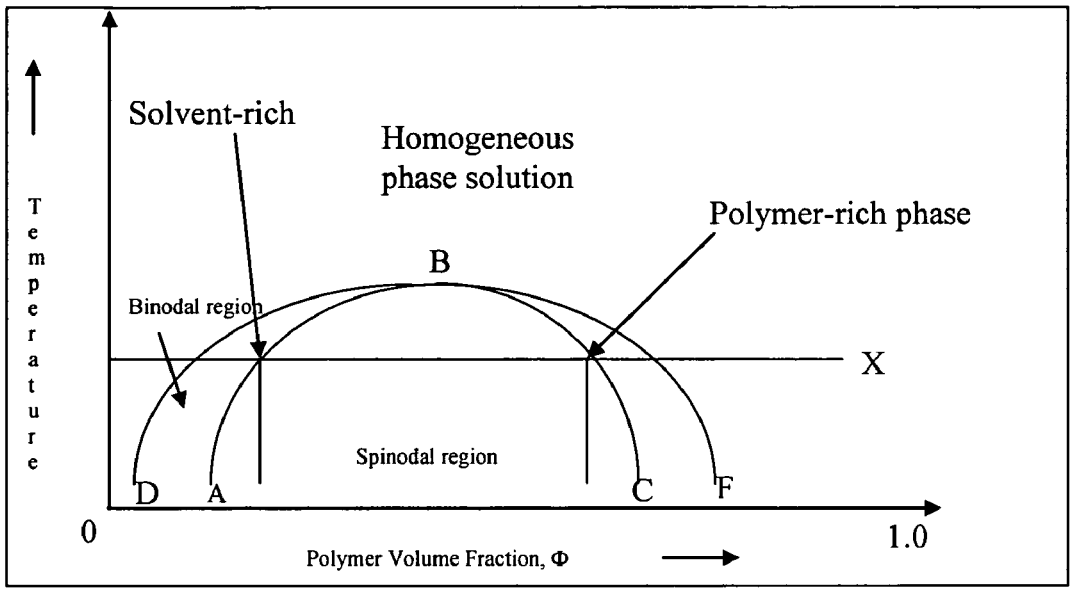
FIG. 1 shows a schematic of a phase diagram for polymer-solvent mixtures (e.g., polymer volume fraction as a function of temperature).

The invention is directed to a method of manufacturing a chemical-mechanical polishing (CMP) pad comprising a porous polymeric sheet material. Preferably, the polishing pad substrate has at least a certain degree of transparency. In some embodiments the polishing pad substrate can be a portion within a polishing pad, or the polishing pad substrate can be an entire polishing pad (e.g., the entire polishing pad or polishing top pad is transparent). In some embodiments, the polishing pad substrate consists of, or consists essentially of, the porous material. The polishing pad substrate comprises a volume of the polishing pad that is at least 0.5 $cm^3$ (e.g., about 1 $cm^3$).

The porous material of the polishing pad substrate has an average pore size of about 0.01 microns to about 10 microns. Preferably, the average pore size is about 0.01 to about 5 microns, more preferably about 0.01 to about 2 microns. In some embodiments the average pore size is in the range of about 0.05 microns to about 0.9 microns (e.g., about 0.1 microns to about 0.8 microns). While not wishing to be bound to any particular theory, it is believed that pore sizes greater than about 1 micron will scatter incident radiation, while pore size less than about 1 micron will scatter less incident radiation, or will not scatter the incident radiation at all, thereby providing the polishing pad substrate with a desirable degree of transparency.

The porous material of the polishing pad substrate has a highly uniform distribution of pore sizes (i.e., cell sizes). Typically, about 75% or more (e.g., about 80% or more, or about 85% or more) of the pores (e.g., cells) in the porous material have a pore size distribution of about ±0.5 μm or less (e.g., about ±0.3 μm or less, or about ±0.2 μm or less) from the average pore size. In other words, about 75% or more (e.g., about 80% or more, or about 85% or more) of the pores in the porous material have a pore size within about 0.5 μm or less (e.g., about 0.3 μm or less, or about 0.2 μm or less) of the average pore size. Preferably, about 90% or more (e.g., about 93% or more, or about 95% or more) of the pores (e.g., cells) in the porous material have a pore size distribution of about ±0.5 μm or less (e.g., about ±0.3 μm or less, or about ±0.2 μm or less).

In some embodiments, the porous material of the polishing pad substrate comprises predominantly closed cells (i.e., pores); however, the porous material can also comprise open cells. In such embodiments the porous material preferably comprises at least about 10% or more (e.g., at least about 20% or more) closed cells, more preferably at least about 30% or more (e.g., at least about 50% or more, or at least about 70% or more) closed cells.

In other embodiments porous material of the polishing pad substrate and polishing pads of the invention comprise comprising the substrate have predominately open cells, which together form a network of substantially interconnected pores.

The porous material of the polishing pad substrate can have any suitable density or void volume. Typically, the porous material has a density of about 0.2 $g/cm^3$ or greater (e.g., about 0.3 $g/cm^3$ or greater, or even about 0.4 $g/cm^3$ or greater), preferably a density of about 0.5 $g/cm^3$ or greater (e.g., about 0.7 $g/cm^3$ or greater, or even about 0.9 $g/cm^3$ or greater). The porosity (i.e., void volume) typically is about 90% or less (e.g., about 75% or less, or even about 50% or less), preferably about 25% or less (e.g., about 15% or less, about 10% or less, or even about 5% or less). Typically the porous material has a cell density of about $10^5$ cells/$cm^3$ or greater (e.g., about $10^6$ cells/$cm^3$ or greater). The cell density is determined by analyzing a cross-sectional image (e.g., an SEM image) of a porous material with an image analysis software program such as OPTIMAS® imaging software and IMAGEPRO® imaging software, both by Media Cybernetics, or CLEMEX VISION® imaging software by Clemex Technologies.

The porous material of the polishing pad substrate can comprise any suitable material and typically comprises a polymer resin. The porous material preferably comprises a polymer resin selected from the group consisting of thermoplastic elastomers, thermoplastic polyurethanes, polyolefins, polycarbonates, polyvinylalcohols, nylons, elastomeric rubbers, styrenic polymers, polyaromatics, fluoropolymers, polyimides, cross-linked polyurethanes, cross-linked polyolefins, polyethers, polyesters, polyacrylates, elastomeric polyethylenes, polytetrafluoroethylene, polyethyleneterephthalate, polyimides, polyaramides, polyarylenes, polystyrenes, polymethylmethacrylates, copolymers and block copolymers thereof, and mixtures and blends of two or more of the foregoing. Preferably, the polymer resin is thermoplastic polyurethane.

The polymer resin typically is a pre-formed polymer resin; however, the polymer resin also can be formed in situ according to any suitable method, many of which are known in the art (see, for example, *Szycher's Handbook of Poly-*

*urethanes,* CRC Press: New York, 1999, Chapter 3). For example, thermoplastic polyurethane can be formed in situ by reaction of urethane prepolymers, such as isocyanate, di-isocyanate, and tri-isocyanate prepolymers, with a prepolymer containing an isocyanate reactive moiety. Suitable isocyanate reactive moieties include amines and polyols.

The selection of the polymer resin will depend, in part, on the rheology of the polymer resin. Rheology is the flow behavior of a polymer melt. For Newtonian fluids, the viscosity is a constant defined by the ratio between the shear stress (i.e., tangential stress, $\sigma$) and the shear rate (i.e., velocity gradient, $d\gamma/dt$). However, for non-Newtonian fluids, shear rate thickening (dilatancy) or shear rate thinning (pseudo-plasticity) may occur. In shear rate thinning cases, the viscosity decreases with increasing shear rate. It is this property that allows a polymer resin to be used in melt fabrication (e.g., extrusion, injection molding) processes. In order to identify the critical region of shear rate thinning, the rheology of the polymer resins must be determined. The rheology can be determined by a capillary technique in which the molten polymer resin is forced under a fixed pressure through a capillary of a particular length. By plotting the apparent shear rate versus viscosity at different temperatures, the relationship between the viscosity and temperature can be determined. The Rheology Processing Index (RPI) is a parameter that identifies the critical range of the polymer resin. The RPI is the ratio of the viscosity at a reference temperature to the viscosity after a change in temperature equal to 20° C. for a fixed shear rate. When the polymer resin is thermoplastic polyurethane, the RPI preferably is about 2 to about 10 (e.g., about 3 to about 8) when measured at a shear rate of about 150 l/s and a temperature of about 205° C.

Another polymer viscosity measurement is the Melt Flow Index (MFI) which records the amount of molten polymer (in grams) that is extruded from a capillary at a given temperature and pressure over a fixed amount of time. For example, when the polymer resin is thermoplastic polyurethane or polyurethane copolymer (e.g., a polycarbonate silicone-based copolymer, a polyurethane fluorine-based copolymers, or a polyurethane siloxane-segmented copolymer), the MFI preferably is about 20 or less (e.g., about 15 or less) over 10 minutes at a temperature of 210° C. and a load of 2160 g. When the polymer resin is an elastomeric polyolefin or a polyolefin copolymer (e.g., a copolymer comprising an ethylene $\alpha$-olefin such as elastomeric or normal ethylene-propylene, ethlene-hexene, ethylene-octene, and the like, an elastomeric ethylene copolymer made from metallocene based catalysts, or a polypropylene-styrene copolymer), the MFI preferably is about 5 or less (e.g., about 4 or less) over 10 minutes at a temperature of 210° C. and a load of 2160 g. When the polymer resin is a nylon or polycarbonate, the MFI preferably is about 8 or less (e.g., about 5 or less) over 10 minutes at a temperature of 210° C. and a load of 2160 g.

The rheology of the polymer resin can depend on the molecular weight, polydispersity index (PDI), the degree of long-chain branching or cross-linking, glass transition temperature ($T_g$), and melt temperature ($T_m$) of the polymer resin. When the polymer resin is thermoplastic polyurethane or polyurethane copolymer (such as the copolymers described above), the weight average molecular weight ($M_w$) is typically about 50,000 g/mol to about 300,000 g/mol, preferably about 70,000 g/mol to about 150,000 g/mol, with a PDI of about 1.1 to about 6, preferably about 2 to about 4. Typically, the thermoplastic polyurethane has a glass transition temperature of about 20° C. to about 110° C. and a melt transition temperature of about 120° C. to about 250° C. When the polymer resin is an elastomeric polyolefin or a polyolefin copolymer (such as the copolymers described above), the weight average molecular weight ($M_w$) typically is about 50,000 g/mol to about 400,000 g/mol, preferably about 70,000 g/mol to about 300,000 g/mol, with a PDI of about 1.1 to about 12, preferably about 2 to about 10. When the polymer resin is nylon or polycarbonate, the weight average molecular weight ($M_w$) typically is about 50,000 g/mol to about 150,000 g/mol, preferably about 70,000 g/mol to about 100,000 g/mol, with a PDI of about 1.1 to about 5, preferably about 2 to about 4.

The polymer resin selected for the porous material preferably has certain mechanical properties. For example, when the polymer resin is a thermoplastic polyurethane, the Flexural Modulus (ASTM D790) preferably is about 350 MPa (~50,000 psi) to about 1000 MPa (~150,000 psi), the average % compressibility is about 7 or less, the average % rebound is about 35 or greater, and the Shore D hardness (ASTM D2240-95) is about 40 to about 90 (e.g., about 50 to about 80).

The polishing pad substrate has a light transmittance of about 10% or more (e.g., about 20% or more) at least one wavelength in the range of about 200 nm to about 35,000 nm at a pad thickness of about 0.075 cm to about 0.2 cm. Preferably, the porous material has a light transmittance of about 30% or more (e.g., about 40% or more, or even about 50% or more) at least one wavelength in the range of about 200 nm to about 35,000 nm (e.g., about 200 nm to about 10,000 nm, or about 200 nm to about 1,000 nm, or even about 200 nm to about 800 nm). The light transmittance of the polishing pad substrate is at least in part determined by controlling properties of the porous material selected from the group consisting of density, void volume, Flexural Modulus, and combinations thereof.

The polishing pad substrate of the invention offers improved consistency of the light transmittance over the lifetime of the polishing pad substrate. This feature arises from the fact that the pores are present throughout the thickness of the polishing pad substrate. Thus, when the surface layer is removed during polishing, the subsequent layers beneath the surface have substantially similar porosity and roughness, and thus have substantially similar polishing properties and light transmittance properties to the top surface layer. In addition, the transmissivity of the polishing pad substrate is on average lower than the same material without pores because of the roughness, and so the percentage change in light scattering due to any change resulting from abrasion of the polishing pad substrate during polishing is also lessened. Desirably, the light transmittance of the polishing pad substrate decreases by less than about 20% (e.g., less than about 10%, or even less than about 5%) over the lifetime of the polishing pad substrate. These changes, taken together, will lessen or even obviate the need to adjust the gain of the endpoint detection system over the lifetime of the polishing pad substrate. For example, the consistency in light transmittance of the polishing pad substrate of the invention can be compared to a solid, or nearly solid, polyurethane window of the prior art. Before polishing, solid polyurethane windows have consistent surface properties; however, during polishing the window becomes abraded and scratched giving rise to inconsistent surface properties. Therefore, an endpoint detection system must be constantly adjusted in response to each new pattern of scratches that arises during polishing. Contrastingly, the polishing pad substrate of the invention begins with a roughened surface that remains substantially unchanged during and after abrasion during polishing such that the endpoint detection settings can remain substantially unchanged over the lifetime of the polishing pad substrate.

The presence of pores in the polishing pad substrate of the invention can have a significant effect on the polishing properties. For example, in some cases, the pores are capable of absorbing and transporting polishing slurry. Thus, the transmissive region can have polishing properties that are more similar to the remaining portions of the polishing pad. In some embodiments, the surface texture of the transmissive polishing pad substrate is sufficient to make the polishing pad substrate useful as a polishing surface without the need for a second, opaque portion of the polishing pad that is used exclusively for polishing.

The polishing pad substrate of the invention optionally further comprises a dye, which enables the substrate to selectively transmit light of a particular wavelength(s). The dye acts to filter out undesired wavelengths of light (e.g., background light) and thus improve the signal to noise ratio of detection. The polishing pad substrate can comprise any suitable dye or may comprise a combination of dyes. Suitable dyes include polymethine dyes, di-and tri-arylmethine dyes, aza analogues of diarylmethine dyes, aza (18) annulene dyes, natural dyes, nitro dyes, nitroso dyes, azo dyes, anthraquinone dyes, sulfur dyes, and the like. Desirably, the transmission spectrum of the dye matches or overlaps with the wavelength of light used for in situ endpoint detection. For example, when the light source for the endpoint detection (EPD) system is a HeNe laser, which produces visible light having a wavelength of about 540 to 570 nm, the dye preferably is a red dye. In a preferred embodiment a polishing pad of the invention is prepared by a spinodal or bimodal decomposition process, and a 0.15 cm thick segment of the polishing pad transmits at least about 10%, more preferably about 20%, of light having a wavelength of about 540 to 570 nm.

The polishing pad substrate of the invention can be produced using any suitable technique, many of which are known in the art. For example, the polishing pad substrate can be produced by (a) a mucell process, (b) a sol-gel process, (c) a phase inversion process, (d) a spinodal decomposition, (e) a binodal decomposition, (f) a solvent-non-solvent induced phase separation, or (g) a pressurized gas injection process.

The mucell process involves (a) combining a polymer resin with a supercritical gas to produce a single-phase solution and (b) forming a polishing pad substrate of the invention from the single-phase solution. The polymer resin can be any of the polymer resins described above. A supercritical gas is generated by subjecting a gas to an elevated temperature (e.g., about 100° C. to about 300° C.) and pressure (e.g., about 5 MPa (~800 psi) to about 40 MPa (~6000 psi)) sufficient to create a supercritical state in which the gas behaves like a fluid (i.e., a supercritical fluid, SCF). The gas can be a hydrocarbon, chlorofluorocarbon, hydrochlorofluorocarbon (e.g., freon), nitrogen, carbon dioxide, carbon monoxide, or a combination thereof. Preferably, the gas is a non-flammable gas, for example a gas that does not contain C—H bonds. The single-phase solution of the polymer resin and the supercritical gas typically is prepared by blending the supercritical gas with molten polymer resin in a machine barrel. The single-phase solution then can be injected into a mold, where the gas expands to form a pore structure with high uniformity of pore size within the molten polymer resin. The concentration of the supercritical gas in the single-phase solution typically is about 0.01% to about 5% (e.g., about 0.1% to about 3%) of the total volume of the single-phase solution. These and additional process features are described in further detail in U.S. Pat. No. 6,284,810. The microcellular structure is formed by creating a thermodynamic instability in the single-phase solution (e.g., by rapidly changing the temperature and/or pressure) sufficient to produce greater than about $10^5$ nucleation sites per $cm^3$ of the solution. Nucleation sites are the sites at which the dissolved molecules of the supercritical gas form clusters from which the cells in the porous material grow. The number of nucleation sites is estimated by assuming that the number of nucleation sites is approximately equal to the number of cells formed in the polymer material. Typically, the thermodynamic instability is induced at the exit of the mold or die which contains the single-phase solution. The porous material can be formed from the single-phase solution by any suitable technique including extrusion into a polymer sheet, co-extrusion of multilayer sheets, injection molding, compression molding, blow molding, blown film, multilayer blown film, cast film, thermoforming, and lamination. Preferably, the polishing pad substrate (e.g., the porous material) is formed by extrusion or injection molding. The pore size of the porous material is at least in part controlled by the temperature, pressure, and concentration of the supercritical gas, and combinations thereof.

The sol-gel process involves the preparation of a three-dimensional metal oxide network (e.g., siloxane network) having a controllable pore size, surface area, and pore size distribution. Such three-dimensional networks (i.e., sol-gels) can be prepared using a variety of methods, many of which are known in the art. Suitable methods include single-step (e.g., "one-pot") methods and two-step methods. In one method, a dilute, aqueous solution of silica (e.g., sodium silicate) is prepared which spontaneously condenses under appropriate pH and salt concentration conditions, to form the silicon-based network. Another typical method involves the use of metal alkoxide precursors (e.g., $M(OR)_4$, wherein M is Si, Al, Ti, Zr, or a combination thereof, and R is an alkyl, aryl, or a combination thereof) which when placed in a solvent containing water and an alcohol, undergo hydrolysis of the alkoxide ligands and condensation (e.g., polycondensation) resulting in the formation of M-O-M linkages (e.g., Si—O—Si siloxane linkages). Optionally, catalysts such as protic acids (e.g., HCl) and bases (e.g., ammonia) can be used to improve the kinetics of the hydrolysis and condensation reactions. Two-step methods typically involve the use of pre-polymerized precursors such as pre-polymerized tetraethyl orthosilicate (TEOS). As the number of M-O-M linkages increases, a three-dimensional network is formed which contains pores that are filled with solvent (e.g., water). The solvent can be exchanged with alcohol to form a structure referred to as an alcogel. Simple evaporation of the solvent typically leads to considerable destruction of the solid three-dimensional network resulting in the formation of a xerogel. A more preferred drying technique, which does not result in substantial destruction of the solid three-dimensional network, is supercritical extraction. Supercritical extraction typically involves combining the solid three-dimensional network with a suitable low molecular weight expanding agent (such as an alcohol, in particular methanol, as is present in an alcogel, or $CO_2$ gas which is accomplished by gas/solvent exchange) and applying a temperature and pressure to the mixture that is above the critical point of the expanding agent. Under these conditions, vitrification, cross-linking, or polymerization of the solid material can occur. The pressure is then slowly lowered to allow the expanding agent to diffuse out of the vitrified structure. The resulting sol-gel material, referred to as an aerogel, has a microcellular pore structure in which the average pore size and pore size distribution can be controlled. Such aerogel materials can be transparent to visible or ultraviolet light having a wavelength above 250 nm. Hybrid organic-inorganic sol-gel materials also can be transparent, or at least partially transparent. Hybrid sol-gel materials typically are prepared using chemical precursors containing both inorganic and organic groups. When a three-dimensional M-O-M network is formed from such precursors, the organic groups can become trapped inside the pore structure. The pore size can be controlled through the selection of an appropriate organic group. Examples of hybrid sol-gel materials include clay-polyamide hybrid materials and metal oxide-polymer hybrid materials.

The phase inversion process involves the dispersion of extremely fine particles of a polymer resin that have been heated above the $T_m$ or $T_g$ of the polymer in a highly agitated non-solvent. The polymer resin can be any of the polymer resins described above. The non-solvent can be any suitable solvent having a high Flory-Higgins polymer-solvent interaction parameter (e.g., a Flory-Higgins interaction parameter greater than about 0.5). Such polymer-solvent interactions are discussed in more detail in Ramanathan et al. in the following references: *Polymer Data Handbook,* Ed. James E. Mark, Oxford University Press, New York, p. 874, c. 1999; Oberth *Rubber Chem. and Technol.* 1984, 63, 56; Barton in *CRC Handbook of Solubility Parameters and Other Cohesion Parameters* CRC Press, Boca Raton, Fla., 1983, p. 256; and Prasad et al. *Macromolecules* 1989, 22, 914. For example, when the polymer resin is a thermoplastic polyurethane, an aromatic ether-based polyurethane, strongly polar solvents such as ethers, ketones, chloroform, tetrahydrofuran (THF), dimethylacetamide (DMA), dimethylformamide (DMF), and the like have interaction parameters less than 0.3 and will act as "good solvents" for the polymer. On the other hand, hydrocarbon solvents such as cyclohexane, cyclobutane, and n-alkanes have an interaction parameter greater than 0.5 and function as poor solvents or "non-solvents." The Flory-Higgins interaction parameter is sensitive to temperature so a solvent that is a good solvent at high temperatures may become a non-solvent at lower temperatures. As the number of fine polymer resin particles added to the non-solvent increases, the fine polymer resin particles connect to form initially as tendrils and ultimately as a three-dimensional polymer network. The non-solvent mixture is then cooled causing the non-solvent to form into discrete droplets within the three-dimensional polymer network. The resulting material is a polymer material having sub-micron pore sizes.

The spinodal decomposition and binodal decomposition processes involve controlling the temperature and/or volume fraction of a polymer-polymer mixture, or a polymer-solvent mixture, so as to move the mixture from a single-phase region into a two-phase region. Within the two-phase region, either spinodal decomposition or binodal decomposition of the polymer mixture can occur. Decomposition refers to the process by which a polymer-polymer mixture changes from a nonequilibrium phase to an equilibrium phase. In the spinodal region, the free energy of mixing curve is negative such that phase separation of the polymers (i.e., formation of a two-phase material), or phase separation of the polymer and the solvent, is spontaneous in response to small fluctuations in the volume fraction. In the binodal region, the polymer mixture is stable with respect to small fluctuations in volume fraction and thus requires nucleation and growth to achieve a phase-separated material. Precipitation of the polymer mixture at a temperature and volume fraction within the two-phase region (i.e., the binodal or spinodal region) results in the formation of a polymer material having two phases. If the polymer mixture is laden with a solvent or a gas, the biphasic polymer material will contain sub-micron pores at the interface of the phase-separation. The polymers preferably comprise the polymer resins described above.

The solvent-non-solvent induced phase separation process involves a ternary phase system where a polymer is dissolved in a suitable solvent at a suitable temperature forming continuous phase. A suitable non-solvent then is added, usually at a fixed temperature, which alters the solubility characteristics of the ternary-phase polymer system to effect sequential phase separation. The sheet morphology can be controlled by changing the solvent/non-solvent ratio. The physical factors that are at least in part responsible for the morphology (i.e., pore structure) of the resulting sheet include the heat of mixing of solvent and non-solvent, and polymer-solvent interactions, which depend on the difference in solubility parameters for the polymer in the solvent and non-solvent. Typical solvent/non-solvent ratios used range from about 1:10 to about 1:200, which can provide films with pores ranging in size from about 0.01 microns to about 10 microns. One example of such a ternary system is a water/DMSO/EVAL (ethylene vinyl alcohol) polymer system. An EVAL concentration of about 10% by weight in a water-DMSO mixture (0-75% by weight DMSO) at 50° C. results in a substantially interconnected porous sheet with pore sizes in the range of about 1 to about 10 microns.

The pressurized gas injection process involves the use of high temperatures and pressures to force a supercritical fluid gas into a solid polymer sheet comprising a polymer resin. The polymer resin can be any of the polymer resins described above. Solid extruded sheets are placed at room temperature into a pressure vessel. A supercritical gas (e.g., $N_2$ or $CO_2$) is added to the vessel, and the vessel is pressurized to a level sufficient to force an appropriate amount of the gas into the free volume of the polymer sheet. The amount of gas dissolved in the polymer is directly proportional to the applied pressure according to Henry's law. Increasing the temperature of the polymer sheet increases the rate of diffusion of the gas into the polymer, but also decreases the amount of gas that can dissolve in the polymer sheet. Once the gas has thoroughly saturated the polymer, the sheet is removed from the pressurized vessel. The resulting polymer sheet typically has cell sizes ranging from about 0.5 microns to about 1 micron. If desired, the polymer sheet can be quickly heated to a softened or molten state. As with the mucell process, the pore size of the porous material is at least in part controlled by the temperature, pressure, and concentration of the supercritical gas, and combinations thereof.

When the polishing pad substrate of the invention constitutes only a portion of a polishing pad, the polishing pad substrate can be mounted into a polishing pad using any suitable technique. For example, the polishing pad substrate can be mounted into a polishing pad through the use of adhesives. The polishing pad substrate can be mounted into the top portion of the polishing pad (e.g., the polishing surface), or can be mounted into the bottom portion of the polishing pad (e.g., the subpad). The polishing pad substrate can have any suitable dimensions and can be round, oval, square, rectangular, triangular, and so on. The polishing pad substrate can be positioned so as to be flush with the polishing surface of the polishing pad, or can be recessed from the polishing surface of the polishing pad. The polishing pad can comprise one or more of the polishing pad substrates of the invention. The polishing pad substrate(s) can be placed in any suitable position on the polishing pad relative to the center and/or periphery of the polishing pad.

The polishing pad into which the polishing pad substrate is placed can be made of any suitable polishing pad material, many of which are known in the art. The polishing pad typically is opaque or only partially translucent. The polishing pad can comprise any suitable polymer resin. For example, the polishing pad typically comprises a polymer resin selected from the group consisting of thermoplastic elastomers, thermoplastic polyurethanes, thermoplastic polyolefins, polystyrenes, polycarbonates, polyvinylalcohols, nylons, elastomeric rubbers, elastomeric polyethylenes, polytetrafluoroethylene, polyethyleneteraphthalate, polyimides, polyaramides, polyarylenes, polystyrenes, polymethylmethacrylates, copolymers thereof, and mixtures thereof. The polishing pad can be produced by any suitable method including sintering, injection molding, blow molding, extrusion, solution or melt casting, fiber spinning, thermoforming, and the like. The polishing pad can be solid and non-porous, can contain microporous closed cells, can contain open cells, or can contain a fibrous web onto which a polymer has been molded.

Polishing pads comprising the polishing pad substrate of the invention have a polishing surface which optionally further comprises grooves, channels, and/or perforations which facilitate the lateral transport of polishing compositions across the surface of the polishing pad. Such grooves, channels, or perforations can be in any suitable pattern and can have any suitable depth and width. The polishing pad can have two or more different groove patterns, for example a combination of large grooves and small grooves as described in U.S. Pat. No. 5,489,233. The grooves can be in the form of slanted grooves, concentric grooves, spiral or circular grooves, XY crosshatch pattern, and can be continuous or non-continuous in connectivity. Preferably, the polishing pad comprises at least small grooves produced by standard pad conditioning methods.

Polishing pads comprising the polishing pad substrate of the invention can comprise, in addition to the polishing pad substrate, one or more other features or components. For example, the polishing pad optionally can comprise regions of differing density, hardness, porosity, and chemical compositions. The polishing pad optionally can comprise solid particles including abrasive particles (e.g., metal oxide particles), polymer particles, water-soluble particles, water-absorbent particles, hollow particles, and the like.

Polishing pads comprising the polishing pad substrate of the invention are particularly suited for use in conjunction with a chemical-mechanical polishing (CMP) apparatus. Typically, the apparatus comprises a platen, which, when in use, is in motion and has a velocity that results from orbital, linear, or circular motion, a polishing pad comprising the polishing pad substrate of the invention in contact with the platen and moving with the platen when in motion, and a carrier that holds a workpiece to be polished by contacting and moving relative to the surface of the polishing pad. The polishing of the workpiece takes place by the workpiece being placed in contact with the polishing pad and then the polishing pad moving relative to the workpiece, typically with a polishing composition therebetween, so as to abrade at least a portion of the workpiece to polish the workpiece. The polishing composition typically comprises a liquid carrier (e.g., an aqueous carrier), a pH adjustor, and optionally an abrasive. Depending on the type of workpiece being polished, the polishing composition optionally may further comprise oxidizing agents, organic acids, complexing agents, pH buffers, surfactants, corrosion inhibitors, anti-foaming agents, and the like. The CMP apparatus can be any suitable CMP apparatus, many of which are known in the art. The polishing pad comprising the polishing pad substrate of the invention also can be used with linear polishing tools.

Desirably, the CMP apparatus further comprises an in situ polishing endpoint detection system, many of which are known in the art. Techniques for inspecting and monitoring the polishing process by analyzing light or other radiation reflected from a surface of the workpiece are known in the art. Such methods are described, for example, in U.S. Pat. No. 5,196,353, U.S. Pat. No. 5,433,651, U.S. Pat. No. 5,609,511, U.S. Pat. No. 5,643,046, U.S. Pat. No. 5,658,183, U.S. Pat. No. 5,730,642, U.S. Pat. No. 5,838,447, U.S. Pat. No. 5,872,633, U.S. Pat. No. 5,893,796, U.S. Pat. No. 5,949,927, and U.S. Pat. No. 5,964,643. Desirably, the inspection or monitoring of the progress of the polishing process with respect to a workpiece being polished enables the determination of the polishing end-point, i.e., the determination of when to terminate the polishing process with respect to a particular workpiece.

A polishing pad comprising the polishing pad substrate of the invention can be used alone or optionally can be used as one layer of a multi-layer stacked polishing pad. For example, the polishing pad can be used in combination with a subpad. The subpad can be any suitable subpad. Suitable subpads include polyurethane foam subpads (e.g., Poron® foam subpads from Rogers Corporation), impregnated felt subpads, microporous polyurethane subpads, or sintered urethane subpads. The subpad typically is softer than the polishing pad comprising the polishing pad substrate of the invention and therefore is more compressible and has a lower Shore hardness value than the polishing pad. For example, the subpad can have a Shore A hardness of about 35 to about 50. In some embodiments, the subpad is harder, is less compressible, and has a higher Shore hardness than the polishing pad. The subpad optionally comprises grooves, channels, hollow sections, windows, apertures, and the like. When the polishing pad of the invention is used in combination with a subpad, typically there is an intermediate backing layer such as a polyethyleneterephthalate film, coextensive with and between the polishing pad and the subpad.

Polishing pads comprising the polishing pad substrates of the invention are suitable for use in polishing many types of workpieces (e.g., substrates or wafers) and workpiece materials. For example, the polishing pads can be used to polish workpieces including memory storage devices, semiconductor substrates, and glass substrates. Suitable workpieces for polishing with the polishing pads include memory or rigid disks, magnetic heads, MEMS devices, semiconductor wafers, field emission displays, and other microelectronic substrates, especially microelectronic substrates comprising insulating layers (e.g., silicon dioxide, silicon nitride, or low dielectric materials) and/or metal-containing layers (e.g., copper, tantalum, tungsten, aluminum, nickel, titanium, platinum, ruthenium, rhodium, iridium or other noble metals).

A preferred aspect of the present invention is a method of manufacturing a chemical-mechanical polishing (CMP) pad utilizing a spinodal decomposition, a bimodal decomposition, or a solvent-non-solvent induced phase separation process. The method comprises the sequential steps of (a) forming a layer of a polymer solution comprising a polymer resin dissolved in a solvent therefor; (b) inducing a phase separation in the layer of polymer solution to produce a continuous polymer-rich phase and a liquid solvent-rich phase dispersed within the continuous polymer-rich phase; (c) solidifying the continuous polymer-rich phase to form a porous polymer sheet; (d) removing the solvent-rich phase from the microporous polymer sheet; and (e) forming a CMP pad therefrom. The phase separation induced in the solution can be a spinodal decomposition, a binodal decomposition, a solvent-non-solvent induced phase separation, or a combination thereof. The porous polymeric sheet has a porosity in the range of about 20 to about 90 percent and comprises pores having an average pore diameter in the range of about 0.01 to about 10 microns, and a relatively narrow pore size distribution, e.g., a pore size distribution in which about 75% or more of the pores (e.g., cells) in the porous material have a pore size distribution of about ±5 μm or less, more preferably about ±3 μm or less from the average pore size.

A detailed description of binodal and spinodal decomposition processes to form porous polymeric materials can be found in A. Prasad et al. *Journal of Polymer Science: Part B Polymer Physics,* Vol. 32, pp. 1819-1835 (1993).

A schematic of a liquid-liquid phase separation diagram of a polymer-solvent mixture is shown in FIG. 1. The phase diagram in FIG. 1 shows phases of a polymer-solvent mixture as a function of temperature (y-axis) and polymer volume fraction (x-axis). In the phase diagram of FIG. 1, the polymer is completely soluble in the region of temperature and volume fraction of polymer outside of the curve labeled DBF. the region under the ABC curve is referred to as the spinodal region, whereas the region between the ABC curve and the DBF curve is referred to as the binodal region. Phase separation occurs when the temperature and volume fraction fall within the DBF curve.

For example, at the temperature represented by the line X, a liquid-liquid phase separation occurs where the line X crosses the spinodal ABC curve, forming a polymer-rich liquid phase and a solvent rich liquid phase. Solidification of the polymer from each phase and removal of solvent results in a polymeric material having different sizes depending on which phase is examined. At relatively high polymer concentrations (e.g., at point A in FIG. 1), the polymer-rich phase results in relatively smaller pore size relative to the pore size obtained from solutions having relatively low polymer concentrations. Similarly, relatively dense polymer sheets in which the porosity is relatively low (e.g., about 20 to about 30% with pore size in the range of about 0.01 to about 2 microns) are cast from materials having a relatively high polymer concentration (e.g., at point C in the diagram of FIG. 1). In contrast, a polymer sheet cast from a solution at a polymer concentration at point A in FIG. 1 would have a relatively higher porosity (e.g., about 70 to about 90 percent, with a pore size in the range of about 0.1 to about 5 microns). Furthermore, the interfacial tension is known to control the phase morphology. Hence, one can manipulate the interfacial tension by adding common surfactants to the polymer solution thereby controlling the pore size as desired.

Figure 2:
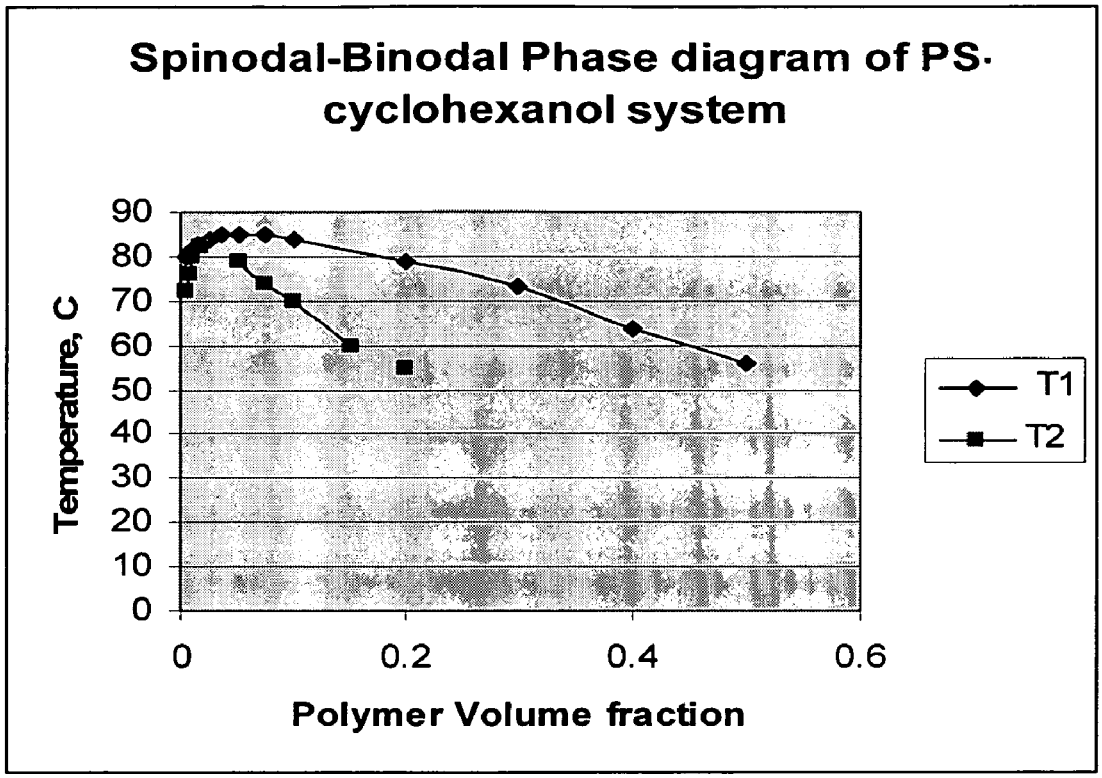
FIG. 2 shows an experimentally determined phase diagram of a polystyrene/cyclohexanol system. (PS Mw=150,000). Homogeneous solution was prepared at 160° C. followed by slow cooling; the data points represent the phase separation boundary as observed by the turbidity in the clear solution; Diamond symbol: Binodal boundary; Square symbol: Spinodal boundary
Figure 3:
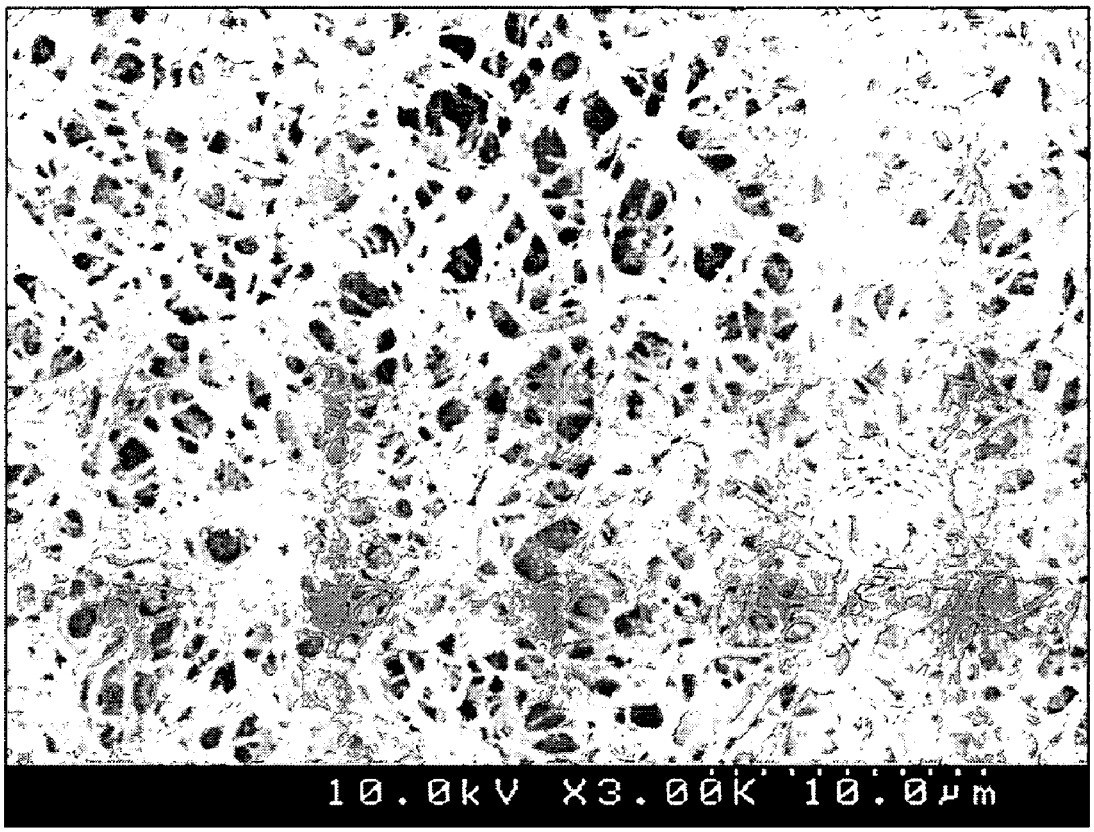
FIG. 3 shows an SEM micrograph of polystyrene porous sheet made via a phase separation process at a polymer concentration of 6 wt % in cyclohexanol at 55° C. for about 10 minutes prior to vacuum drying at room temperature for about 12 hours.

In one example, a polystyrene (molecular weight of 150,000) sheet was cast from a polymer solution comprising about 6 percent by weight of polystyrene dissolved in 100 ml amount of cyclohexanol solvent at about 160° C. An experimentally determined phase diagram for this polystyrene-cyclohexanol system is shown in FIG. 2. The solution was quench cooled to about 55° C. and held there for about 10 minutes to induce phase separation. The polymer phase solidified thereby forming a thermoreversible gel and the solvent was removed by vacuum drying to afford a porous polymer sheet having an open network of substantially interconnected pores ranging in size from about 0.1 to about 5 microns and a porosity (i.e., void volume) of about 75%. A photomicrograph of a porous polystyrene sheet produced by this procedure is shown in FIG. 3.

Figure 4:
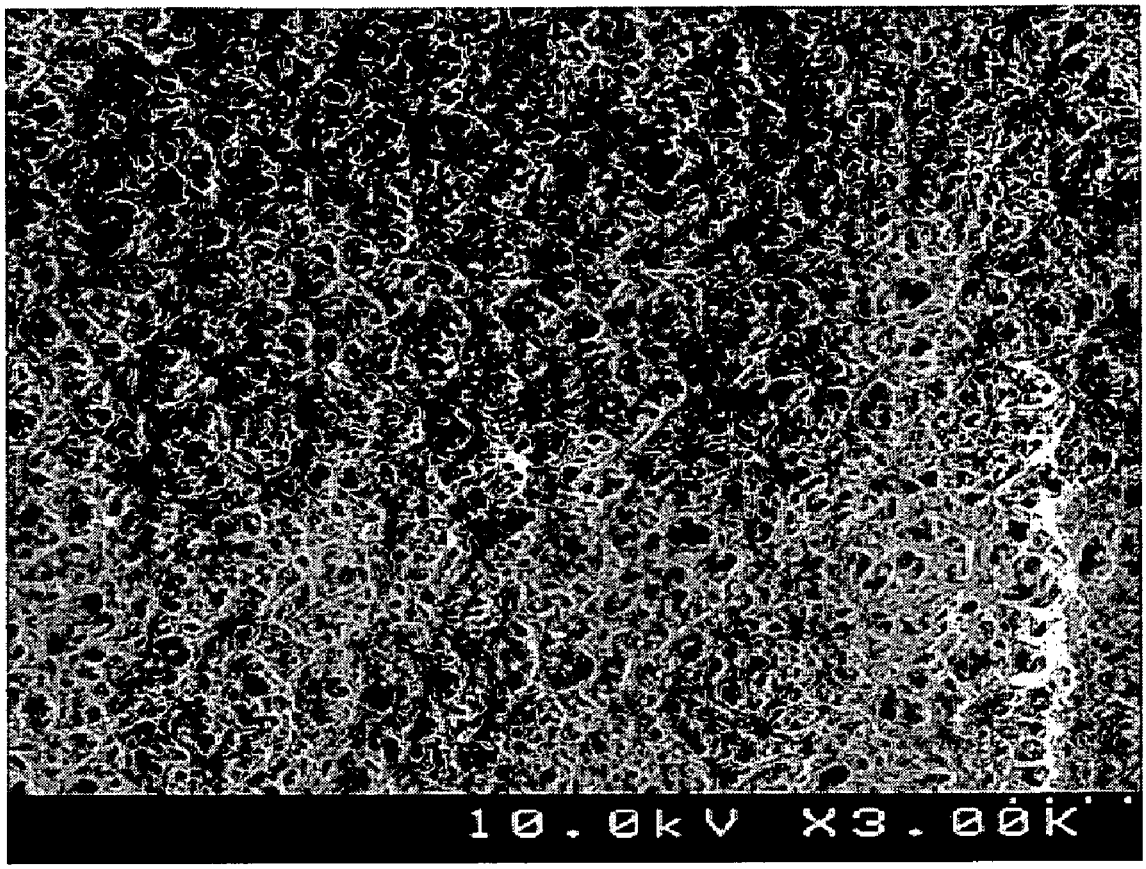
FIG. 4 shows an SEM micrograph of polystyrene porous sheet made via a phase separation process at a polymer concentration of 30 wt % in cyclohexanol at 55° C. for about 10 minutes prior to vacuum drying at room temperature for 24 hours.

Another polystyrene sheet was case from a polymer solution comprising about 30 percent by weight of polystyrene dissolved in 100 ml amount of cyclohexanol solvent at about 160° C. The solution was quench cooled to about 55° C. and held there for about 10 minutes to induce phase separation. The polymer-rich phase solidified (forming a thermoreversible gel) and the solvent was removed by vacuum drying to afford a porous polymer sheet having an open network of substantially interconnected pores ranging in size from about 0.01 to about 2 microns (average pore size of about 1.2 microns) and a porosity (i.e., void volume) of about 20 to about 30%. In all cases, the pore size distribution obtained by the binodal and spinodal decomposition process is relatively narrow (e.g., typically less than about 10 micrometers). a photomicrograph of a porous polystyrene sheet made by this procedure is shown in FIG. 4. This is an example of phase morphology obtained inside the spinodal region of the phase diagram (i.e., a spinodal decomposition).

In another example, 5 wt % of polyethylene (molecular weight=120,000) dissolved in 100 ml of 1-dodecanol at 130° C. was quench cooled to 100° C. This sample solidified in a few minutes, and solvent was removed by vacuum drying to reveal an interconnected open pore structures similar to the porous polystyrene sheet shown in FIG. 3. At a higher concentration of the same polymer (12 wt %) under same cooling conditions, a the pore structure of the sheet was similar to the that shown in FIG. 4 for polystyrene. This is an example of phase morphology obtained between the spinodal and binodal region of the phase diagram.

The porous polymeric sheet of this aspect of the present invention defines a network of substantially interconnected pores. At least a portion of the liquid solvent-rich phase is dispersed within the pores. The microporous polymeric sheet has a porosity (i.e., a void volume) in the range of about 20 to about 90 percent and comprises pores having an average pore diameter in the range of about 0.01 to about 10 microns (e.g., in the range of about 0.01 to about 5 microns, about 0.1 to about 2 microns, and the like).

In some embodiments of the present method the polymeric sheet has an average porosity in the range of about 20 to about 30%. In other embodiments the polymeric sheet has an average porosity in the range of about 70 to about 90%. Pads having a relatively high porosity (e.g., in the range of about 70 to about 90% are particularly useful for electrochemical CMP (e-CMP) processes. The pores of the CMP pads of this embodiment of the present invention are open and interconnected. The open pore structure enhances CMP slurry flow and disposal of debris generated during polishing. The relatively narrow distribution of pore sizes reduces directivity in 65 nm or lower nodes. The ability to form pads of relatively high density (low porosity) also contributes to reduced dishing and erosion.

The method provides for microporous CMP pads having a porosity and pore size that can be readily controlled by selecting the concentration polymer resin in the polymer solution, selecting of the solvent based on the solubility parameters of the polymer in the solvent polarity of solvent, selecting the conditions for phase separation (e.g., the temperature), and the like.

Preferably, the polymeric sheet comprises a polymer resin selected from the group consisting of a thermoplastic elastomer, a thermoplastic polyurethane, a thermoplastic polyolefin, polystyrenes, a polycarbonate, a polyvinylalcohol, a nylon, an elastomeric rubber, an elastomeric polyethylene, a polytetrafluoroethylene, a polyethyleneteraphthalate, a polyimide, a polyaramide, a polyarylene, a polystyrene, a polymethylmethacrylate, a copolymers thereof, and a mixture thereof. More preferably the polymeric sheet comprises a thermoplastic polyurethane.

Examples of suitable classes of solvents for use in this method aspect of the present invention are esters, ethers, alcohols, ketones, nitrites, amines, aromatic hydrocarbons, dimethyl sulfoxide (DMSO). Preferred solvents for use in this method aspect of the present invention are polar aprotic solvents and hydrogen bonding solvents (e.g., N-methylpyrrolidone, dimethylformamide, dimethylacetamide, methyl ethyl ketone (MEK), tetrahydrofuran, and any combination of the foregoing), which are well known in the art. The solvent can be removed from the microporous polymeric sheet by and method known in the art, including without limitation evaporation, solvent exchange, solvent stripping under vacuum, freeze drying, and any combination thereof.

In a preferred embodiment the polymer solution is prepared by dissolving a thermoplastic polyurethane resin (1 to 50 wt %) in NMP or DMF at a temperature above about 80° C. The phase separation is then induced by cooling the layer of polymer solution to a temperature below about 80° C. Other hydrogen bonding solvents such as MEK, THF, and DMA, are also suitable.

The step of removing the solvent-rich phase can be accomplished by any convenient method known in the art, such as by evaporation, by solvent exchange, by solvent stripping under vacuum, freeze drying and by any combination thereof.

In a preferred embodiment of the method of the present invention, the polymer solution comprises about 1 to about 50 percent by weight of the polymer resin, more preferably about 5 to about 20 percent by weight.

Depending on the solubility parameters for the polymer and solvent in the polymer solution, the strength of the polymer-diluent interaction (e.g., when a diluent is used to remove the solvent by solvent exchange), the initial polymer concentration in the polymer solution, the rate of temperature drop used to induce phase separation, and like parameters, the phase separation can be a liquid-liquid phase separation or a liquid-solid phase separation. In some embodiments the polymer can crystallize, at least partially, during or prior to solidification.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A method of manufacturing a chemical-mechanical polishing (CMP) pad comprising the steps of:

(a) forming a layer of a polymer resin liquid solution;

(b) inducing phase separation in the layer of polymer resin liquid solution to form an interconnected polymeric network comprising a continuous polymer-rich phase interspersed with a continuous polymer-depleted phase, the polymer-depleted phase comprising about 20 to about 90 percent of the combined volume of the separated phases, the phase separation being selected from the group consisting of a binodal decomposition, a spinodal decomposition, solvent-non-solvent induced phase separation, and a combination thereof;

(c) solidifying the polymer-rich phase to form a porous polymer sheet defining an open network of substantially interconnected pores and having at least a portion of the polymer-depleted phase dispersed within the pores, the polymer sheet having a porosity in the range of about 20 to about 90 percent by volume, the network of pores comiprising pores having diameters in the range of about 0.01 to about 10 microns;

(d) removing at least a portion of the polymer-depleted phase from the porous polymer sheet, wherein the step of removing the polymer-depleted phase is accomplished by a process selected from the group consisting of evaporation, solvent exchange, solvent stripping under vacuum, freeze drying and any combination thereof; and (e) forming a CMP pad from the porous polymer sheet.

2. The method of claim 1 wherein the polymer resin is selected from the group consisting of a thermoplastic elastomer, a thermoplastic polyurethane, a thermoplastic polyolefin, a polycarbonate, a polyvinylalcohol, a nylon, an elastomeric rubber, an elastomeric polyethylene, a polytetrafluoroethylene, a polyethyleneteraphthalate, a polyimide, a polyaramide, a polyarylene, a polystyrene, a polymethylmethacrylate, a copolymers thereof, and a mixture thereof.

3. The method of claim 1 wherein the polymer resin comprises a thermoplastic polyurethane.

4. The method of claim 1 wherein the polymer resin liquid solution comprises a solvent selected from the group consisting of a polar aprotic solvent and a hydrogen bonding solvent.

5. The method of claim 1 wherein the solvent is selected from the group consisting of N-methylpyrrolidone, dimethylformamide, methyl ethyl ketone, tetrahydrofuran, dimethylacetamide, and a combination thereof.

6. The method of claim 1 wherein the step of inducing a phase separation is accomplished by cooling the layer of polymer resin liquid solution or by adding a non-solvent to the mixture.

7. The method of claim 1 wherein the step of forming a layer of polymer solution is accomplished by casting the polymer resin liquid solution onto a substrate.

8. The method of claim 1 wherein the step of forming a layer of polymer solution is accomplished by extruding a layer of the polymer resin liquid solution onto a substrate.

9. The method of claim 1 wherein the polymer resin liquid solution comprises about 1 to about 50 percent by weight of the polymer resin.

10. The method of claim 1 wherein the polymer resin liquid solution comprises about 5 to about 20 percent by weight of the polymer resin.

* * * * *